US007059834B2

(12) United States Patent
Chlus et al.

(10) Patent No.: US 7,059,834 B2
(45) Date of Patent: Jun. 13, 2006

(54) TURBINE BLADE

(75) Inventors: Wieslaw A. Chlus, Wethersfield, CT (US); Stanley J. Funk, New Britain, CT (US)

(73) Assignee: United Technologies Corporation, Hartford, CT (US)

( * ) Notice: Subject to any disclaimer, the term of this patent is extended or adjusted under 35 U.S.C. 154(b) by 394 days.

(21) Appl. No.: 10/350,635

(22) Filed: Jan. 24, 2003

(65) Prior Publication Data

US 2004/0146401 A1 Jul. 29, 2004

(51) Int. Cl.
*F01D 5/18* (2006.01)

(52) U.S. Cl. ..... 416/92; 416/97 R

(58) Field of Classification Search ..... 415/173.1, 415/173.4; 416/92, 96 A, 90 R, 95, 96 R, 416/224, 97 R
See application file for complete search history.

(56) References Cited

U.S. PATENT DOCUMENTS 3,533,712 A * 10/1970 Kercher ..... 416/92
3,885,886 A * 5/1975 Richter ..... 416/92
4,257,737 A 3/1981 Andress et al.
6,652,235 B1 * 11/2003 Keith et al. ..... 416/92

* cited by examiner

*Primary Examiner*—Edward K. Look
*Assistant Examiner*—Richard A. Edgar
(74) *Attorney, Agent, or Firm*—Bachman & LaPointe, P.C.

(57) ABSTRACT

A turbine blade tip plenum has means for preferentially directing or diverting cooling air from a cooling passageway network to cool areas subject to extreme heat.

20 Claims, 6 Drawing Sheets

TURBINE BLADE

BACKGROUND OF THE INVENTION (1) Field of the Invention

This invention relates to turbomachinery, and more particularly to cooled turbine blades.

(2) Description of the Related Art

Heat management is an important consideration in the engineering and manufacture of turbine blades. Blades are commonly formed with a cooling passageway network. A typical network receives cooling air through the blade platform. The cooling air is passed through convoluted paths through the airfoil, with at least a portion exiting the blade through apertures in the airfoil. These apertures may include holes (e.g., "film holes" distributed along the pressure and suction side surfaces of the airfoil and holes at junctions of those surfaces at leading and trailing edges. Additional apertures may be located at the blade tip. In common manufacturing techniques, a principal portion of the blade is formed by,a casting and machining process. During the casting process a sacrificial core is utilized to form at least main portions of the cooling passageway network. Proper support of the core at the blade tip is associated with portions of the core protruding through tip portions of the casting and leaving associated holes when the core is removed. Accordingly, it is known to form the casting with a tip pocket into which a plate may be inserted to at least partially obstruct the holes left by the core. This permits a tailoring of the volume and distribution of flow through the tip to achieve desired performance. Examples of such constructions are seen in U.S. Pat. Nos. 3,533,712, 3,885,886, 3,982,851, 4,010,531, 4,073,599 and 5,564,902. In a number of such blades, the plate is subflush within the casting tip pocket to leave a blade tip pocket or plenum.

BRIEF SUMMARY OF THE INVENTION

One aspect of the invention involves providing the plenum with means for preferentially directing or diverting cooling air from a leading edge branch of the network along the pressure side of the rim forming the plenum. This may be achieved by a tip plate only partially blocking a leading port in the casting. The plate may have a leading edge positioned to direct flow through the port preferentially along the compression (pressure) side. The plate leading edge may be angled forwardly to a local meanline of the airfoil section. The plate may block more area of the port on the suction side of the mean line than on the pressure side. A length along a pressure side of the blade tip pocket ahead of the plate may be longer than a length along the suction side.

In another aspect of the invention, the blade is provided with means for preferentially directing flow from a trailing passageway to the pressure side. This may be achieved by having a plate trailing portion extending along a suction side of a trailing port but not along an adjacent pressure side. The trailing portion along the suction side may protrude relative to a portion thereahead. The trailing portion along the pressure side may be recessed relative to the portion thereahead.

In another aspect, a wall of the tip plenum may have a side trailing edge gap on one side (e.g., the pressure side) with means for reducing stress concentration at the gap. This may be achieved by having a radius of curvature at a leading inboard corner of the gap effective to relieve thermal and mechanical stresses.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
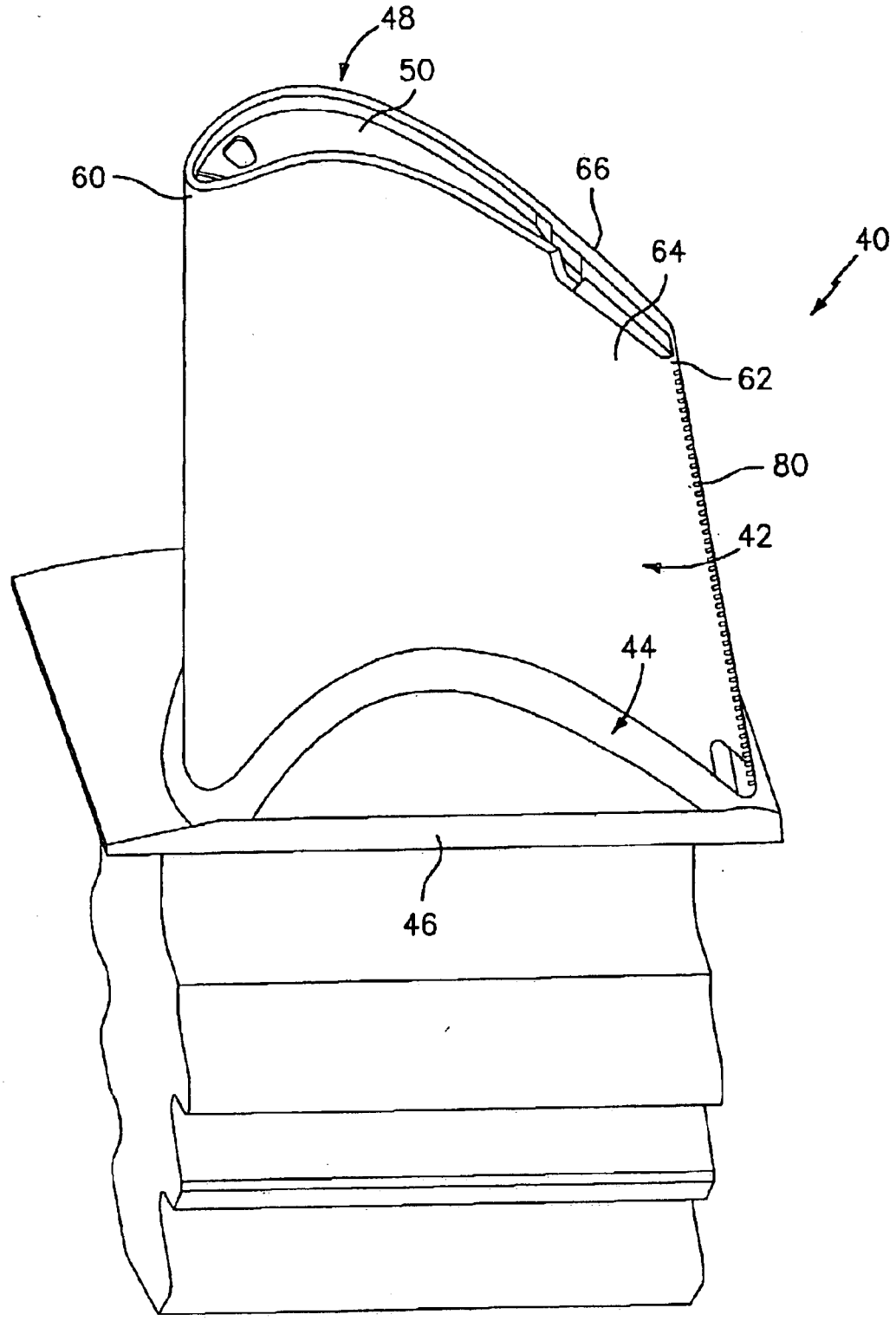
FIG. 1 is a view of a turbine blade according to principles of the invention.

FIG. 1 shows a turbine blade 40 having an airfoil 42 extending along a length from a proximal root 44 at an inboard platform 46 to a distal end tip 48. A number of such blades may be assembly side by side with their respective inboard platforms forming a ring bounding an inboard portion of a flow path. In an exemplary embodiment, a principal portion of the blade is unitarily formed of a metal alloy (e.g., as a casting). The casting is formed with a tip compartment in which a separate cover plate 50 is secured.

The airfoil extends from a leading edge 60 to a trailing edge 62. The leading and trailing edges separate pressure and suction sides or surfaces 64 and 66. For cooling the blade, the blade is provided with a cooling passageway network coupled to ports (not shown) in the platform. The exemplary passageway network includes a series of cavities extending generally lengthwise along the airfoil. A foremost cavity is identified as a leading edge cavity extending generally parallel to the leading edge. An aftmost cavity is identified as a trailing edge cavity extending generally parallel to the trailing edge. These cavities may be joined at one or both ends and/or locations along their lengths. The network may further include holes extending to the pressure and suction surfaces 64 and 66 for further cooling and insulating the surfaces from high external temperatures. Among these holes may be an array of trailing edge holes 80 extending between the trailing edge cavity and a location proximate the trailing edge.

Figure 2:
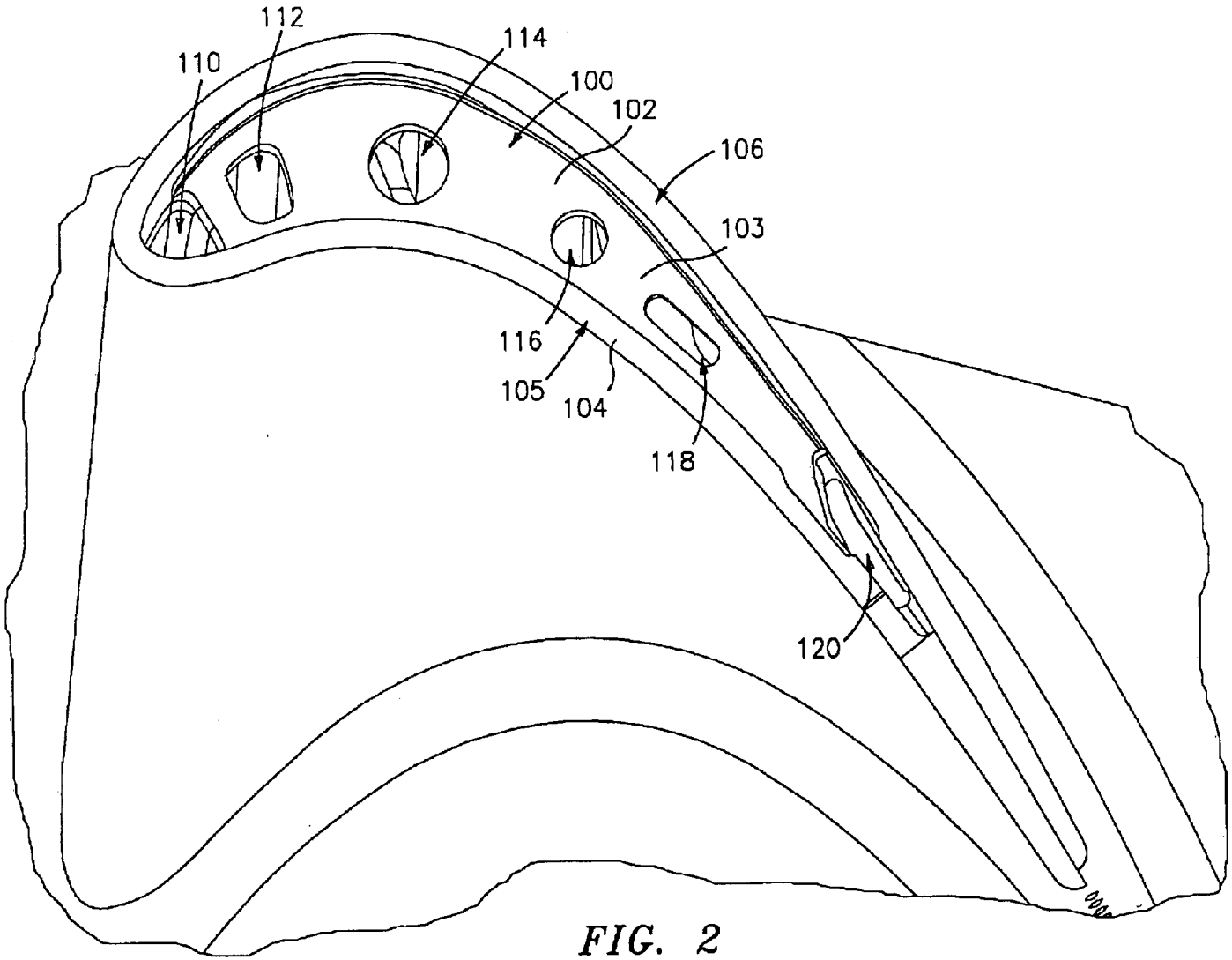
FIG. 2 is a view of a tip of a casting of the blade of FIG. 1.
Figure 3:
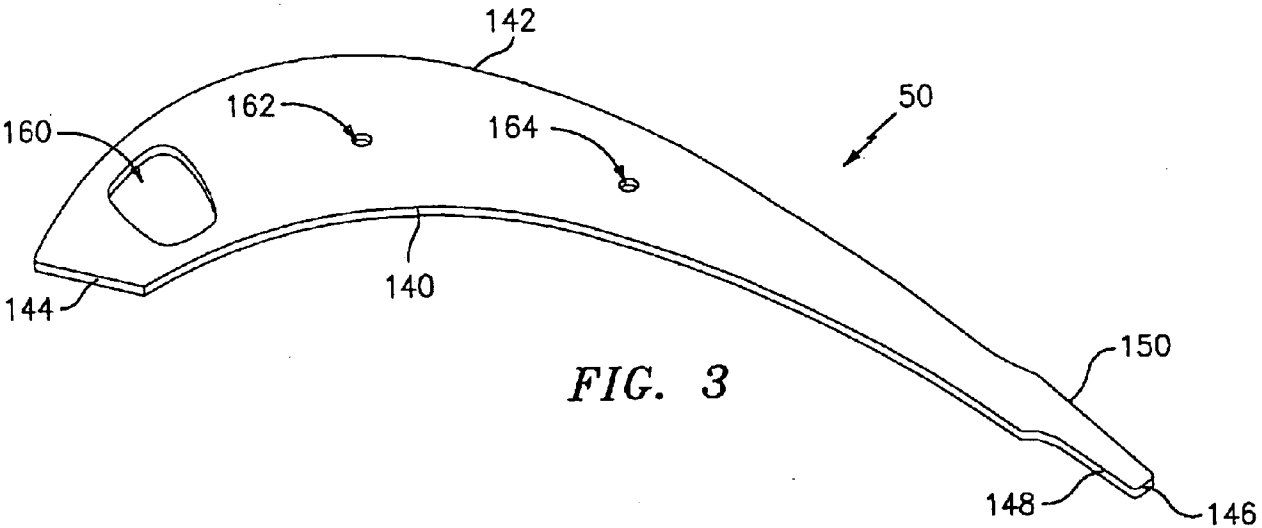
FIG. 3 is a view of a cover plate for a tip compartment of the blade of FIG. 1.
Figure 4:
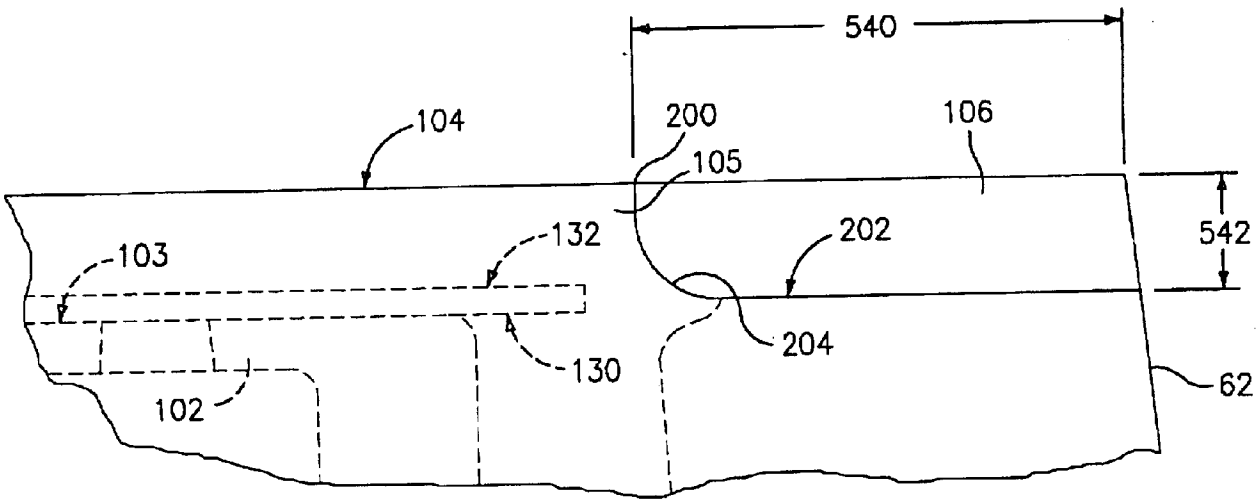
FIG. 4 is a partial view of a trailing edge tip portion of a pressure side of the blade of FIG. 1.
Figure 5:
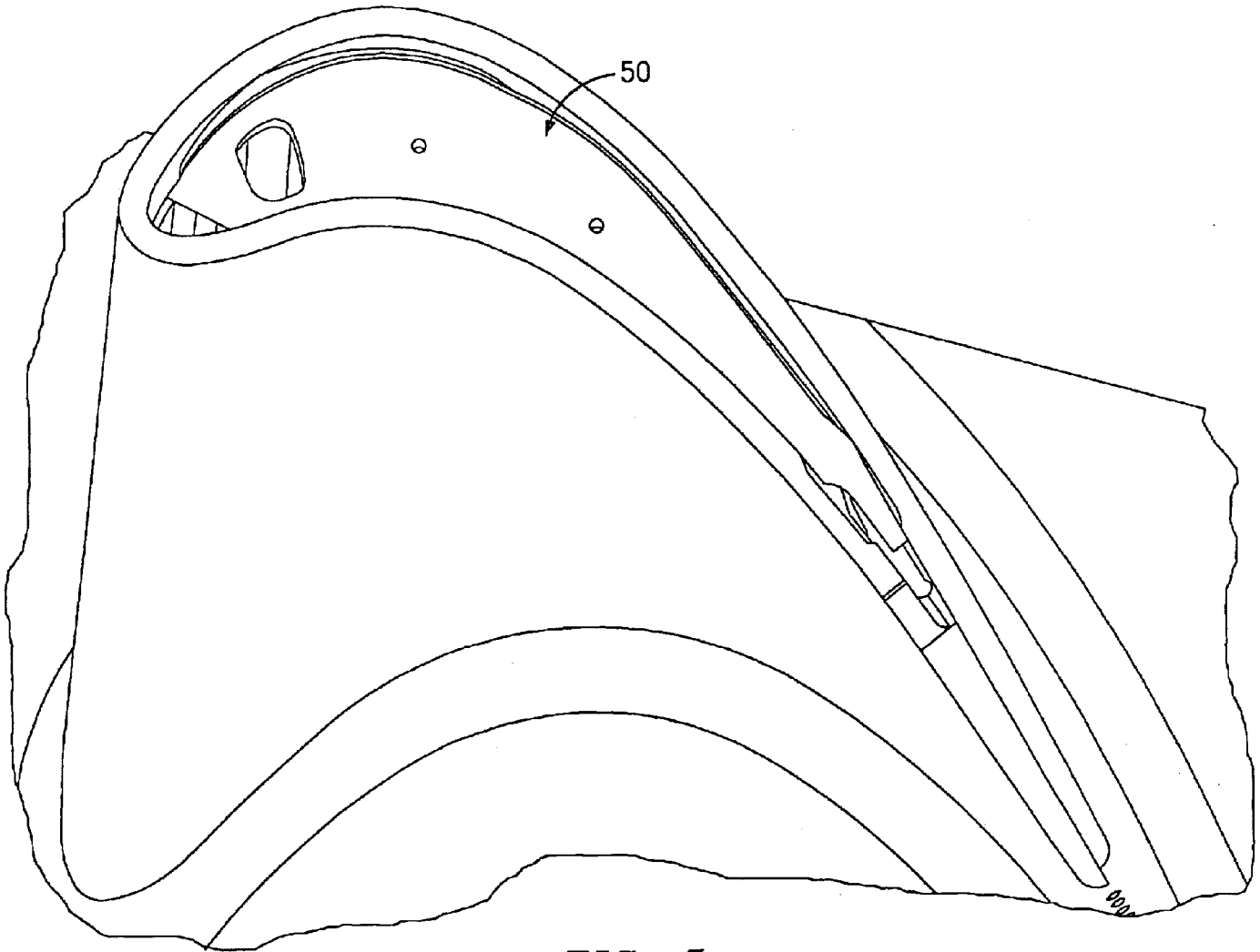
FIG. 5 is a view of the tip of the blade of FIG. 1.

In an exemplary embodiment, the principal portion of the blade is formed by casting and machining. The casting occurs using a sacrificial core to form the passageway network. An exemplary casting process forms the resulting casting with the aforementioned casting tip compartment 100 (FIG. 2). The compartment has a web 102 having an outboard surface 103 forming a base of the casting tip compartment. The outboard surface 103 is below a rim 104 of a wall structure having portions 105 and 106 on pressure and suction sides of the resulting airfoil. The web 102 is formed with a series of apertures 110, 112, 114, 116, 118, and 120 from leading to trailing edge. These apertures may be formed by portions of the sacrificial core mounted to an outboard mold for support. The apertures are in communication with the passageway network. The apertures may represent an undesired pathway for loss of cooling air from the blade. Accordingly it is advantageous to fully or partially block some or all of the apertures with the cover plate 50 (FIG. 3). The cover plate has inboard and outboard surfaces 130 and 132 (FIG. 4). The inboard surface 130 lies flat against the web surface 103 and the outboard surface 132 lies recessed (subflush) below the rim 104 to leave a blade tip pocket or compartment. In operation, the rim (subject to recessing described below) is substantially in close proximity to the interior of the adjacent shroud (e.g., with a gap of about 0.1 inch).

The cover plate 50 is initially formed including a perimeter having a first portion 140 generally associated with the contour of the airfoil pressure side and a second portion 142 generally associated with the airfoil suction side. Exemplary cover plate material is nickel-based superalloy (e.g., UNS N06625 0.03 inch thick). The portions 140 and 142 are (subject to departures describe below) dimensioned to closely fit within the tip compartment adjacent the interior surface of the wall structure portions 105 and 106. In the exemplary embodiment, the perimeter portions 140 and 142 do not extend all the way to the leading edge. They terminate at a linking portion 144 which in the exemplary embodiment is recessed from the leading edge along both pressure and suction sides. Toward the trailing edge, the portions are joined by a trailing perimeter portion 146. As is described in further detail below, a trailing part 148 of the perimeter portion 140 is slightly recessed from a remainder thereof and a trailing part 150 of the perimeter portion 142 is slightly protruding relative to a remainder. The cover plate further includes apertures 160, 162, and 164.

The cover plate 50 is initially formed including a perimeter having a first portion 140 generally associated with the contour of the airfoil pressure side and a second portion 142 generally associated with the airfoil suction side. Exemplary cover plate material is nickel-based superalloy (e.g., UNS N06625 0.03 inch thick). The portions 140 and 142 are (subject to departures describe below) dimensioned to closely fit within the tip compartment adjacent the interior surface of the wall structure portions 105 and 106. In the exemplary embodiment, the perimeter portions 140 and 142 do not extend all the way to the leading edge. They terminate at a cover plate perimeter linking portion 144 which in the exemplary embodiment is recessed from the leading edge along both pressure and suction sides. Toward the trailing edge, the portions are joined by a trailing perimeter portion 146. As is described in further detail below, a trailing part 148 of the perimeter portion 140 is slightly recessed from a remainder thereof and a trailing part 150 of the perimeter portion 142 is slightly protruding relative to a remainder. The cover plate further includes apertures 160, 162, and 164.

Figure 6:
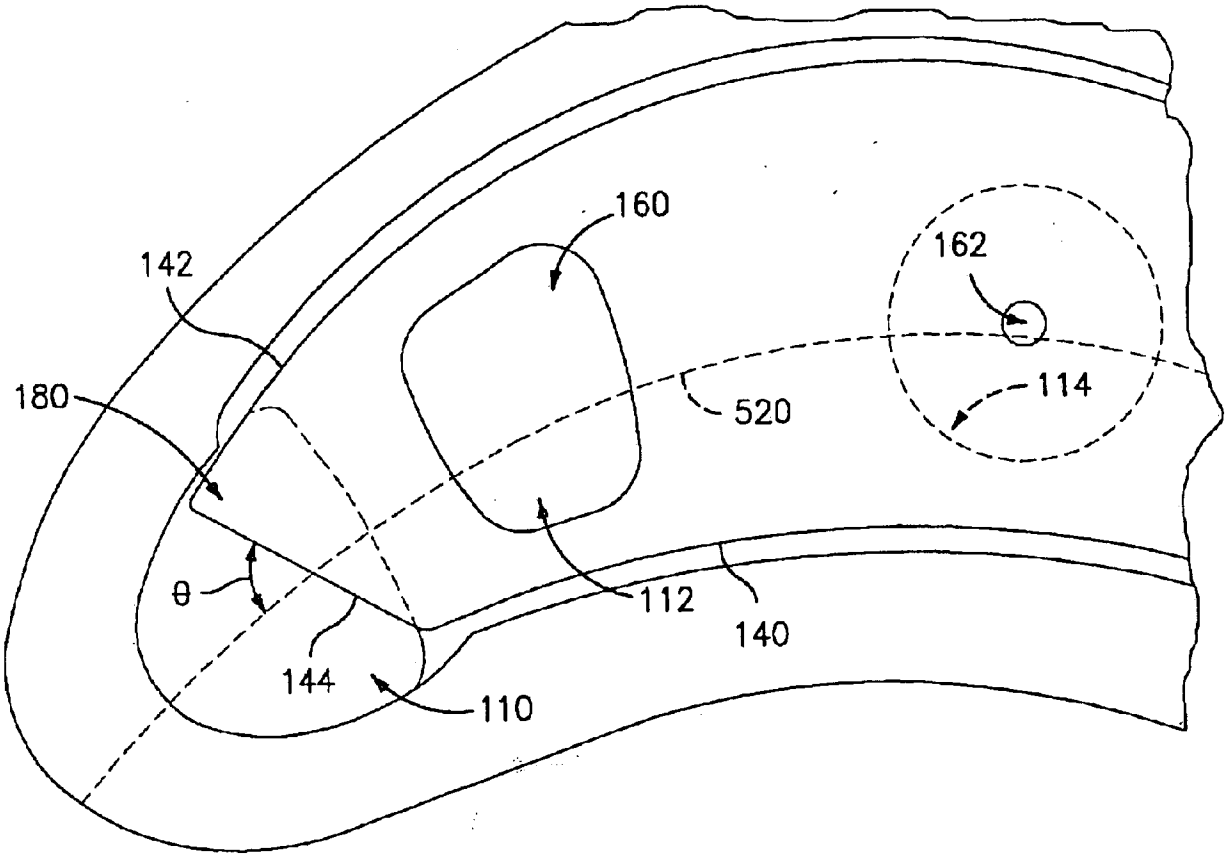
FIG. 6 is a view of a leading portion of the tip of the blade of FIG. 1.

In the exemplary embodiment, when so installed, a leading portion 180 (FIG. 6) of the cover plate partially covers the leading aperture 110 and thus partially blocks the leading edge cavity from communication with the blade tip compartment or plenum. In the exemplary embodiment, the trailing extremity of the aperture 110 is nearly perpendicular to a local mean line 520. Most of the leading portion 180 covering the aperture 110 covers that portion of the aperture on the suction side of the mean line and covers a greater proportion of the aperture area on the suction side than on the pressure side. The nature of the blocking will be influenced by port geometry and airfoil section. In exemplary embodiments, area of the leading port blocked by the plate on the suction side of the mean line is 2–6 times (or, more narrowly 4–5 times) the area blocked on the pressure side.

The shape of the leading portion 180 may vary. In the exemplary embodiment, the cover plate perimeter linking portion 144 is nearly straight and makes an angle θ of lees than 90° with the chordline on the pressure side in the leading direction. Due to this incline, the suction side perimeter portion 142 extends closer to the leading edge than does the pressure side portion 140. The result of this arrangement is that the leading portion 180 preferentially directs airflow toward the pressure side for enhanced cooling on the pressure side. This produces a more efficient use of airflow as the pressure side may require greater cooling.

In the exemplary embodiment, the second web aperture 112 and first cover plate aperture 160 are substantially coextensive whereas the cover plate may substantially or more significantly obstruct the remaining web apertures. In the exemplary embodiment, the cover plate apertures 162 and 164 are aligned with the web apertures 114 and 116 but are substantially smaller and therefore substantially reduce airflow through such apertures. In the exemplary embodiment, the cover plate substantially seals the web aperture 118 and, as described in further detail below, extends partially over the trailing web aperture 120. Relatively low restriction of flow through the aperture 112 provide for efficient use of cooling air as such air can be expected to pass along the greater portion of the tip compartment than would air introduced more toward the trailing edge.

Figure 7:
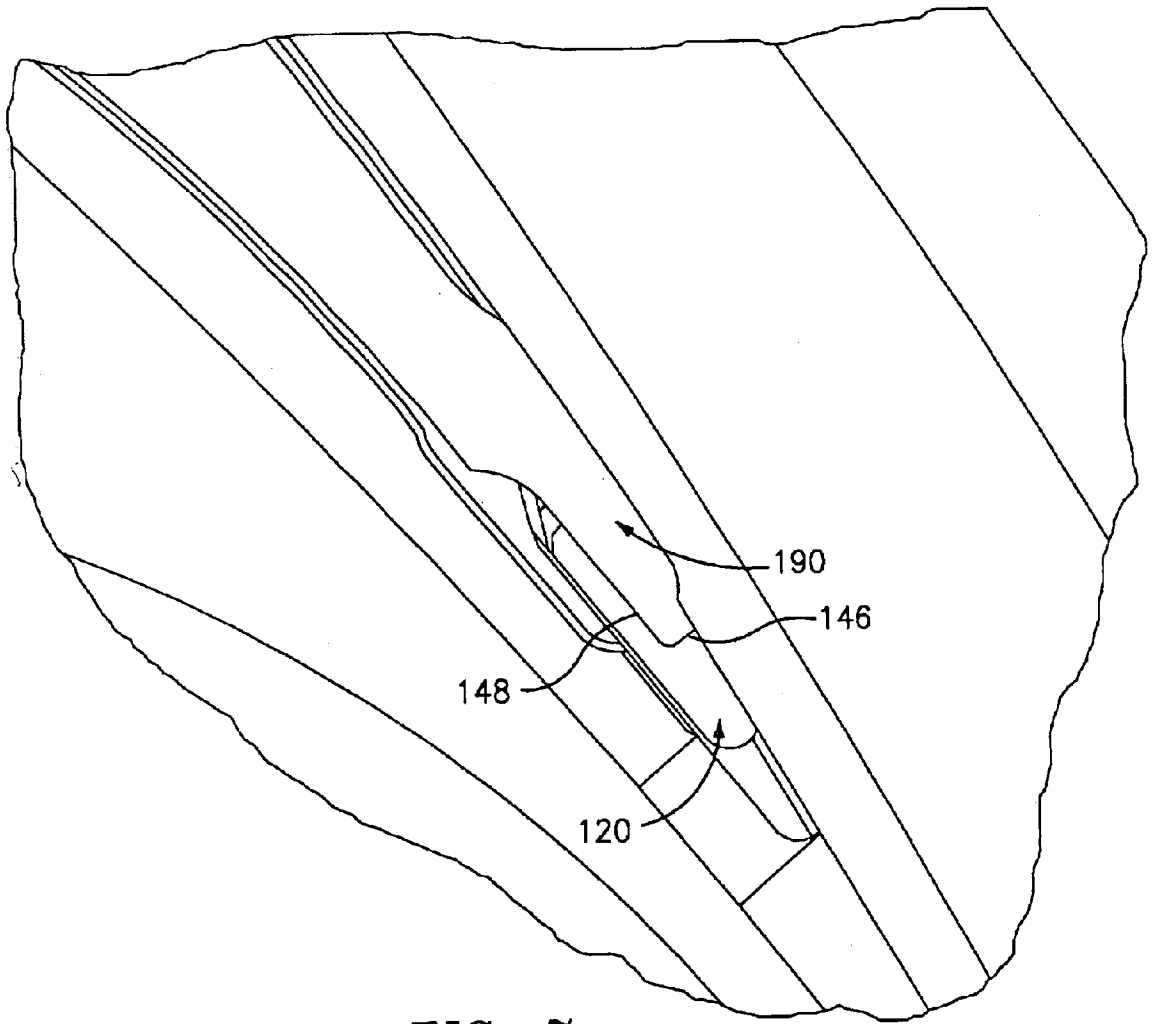
FIG. 7 is a partial view of a trailing portion of a tip compartment of the blade of FIG. 1.

FIG. 7 shows the trailing portion 190 of the cover plate partially covering the trailing aperture 120 of the casting. Specifically, the trailing portion 190 covers a leading suction side portion of the aperture, the recessed part 148 being spaced apart from a suction side perimeter of such aperture. This configuration again preferentially directs the air from the trailing edge cavity through the aperture 120 along the pressure side.

FIG. 4 further shows the suction side tip wall portion 106 extending substantially all the way to the trailing edge 62. The pressure side wall portion 105 does not so extend intact. The wall portion 105 extends intact to a location 200, to the trailing edge of which it is recessed relative to the adjacent area of the wall 106. In the exemplary embodiment, the location 200 is a distance 540 ahead of the trailing edge. In the exemplary embodiment, the wall portion 105 vanishes to the rear of a trailing edge extremity of the trailing edge cavity. The wall portion 105 merges with a base surface 202 recessed relative to the rim 104 along the surface portion 106 by a distance 542. The exemplary distance 542 may be approximately the same as the, recess of the web surface 103 relative to the rim surface 104. A trailing portion of the exemplary wall portion 105 has a continuously curving concave transition 204 to the surface 202. This transition has a radius or radi of curvature and is sufficiently large to reduce thermal/mechanical stress concentrations contrasted with a right angle transition and reduce the chances of resulting cracking. Exemplary radii are between 0.4 and 1.0 times (more narrowly 0.6 and 0.8 times) the distance 542. An exemplary numerical range is between 0.100 inch and 0.300 inch.

One or more embodiments of the present invention have been described. Nevertheless, it will be understood that various modifications may be made without departing from the spirit and scope of the invention. For example, many details will be application-specific. To the extent that the principles are applied to existing applications or, more particularly, as modifications of existing blades, the features of those applications or existing blades may influence the implementation. Accordingly, other embodiments are within the scope of the following claims.

What is claimed is:

1. A blade comprising:

an airfoil body having:

an internal cooling passageway network; and a body tip pocket in communication with the cooling passageway network via a plurality of ports; and at least one plate secured subflush within the body tip pocket, so as to leave a blade tip plenum, and at least partially blocking at least some of the plurality of ports, and having means for directing airflow preferentially along a pressure side of a leading edge portion of a wall of the body tip pocket relative to a suction side of the leading edge portion of the wall of the body tip pocket.

2. The blade of claim 1 wherein the means comprises a leading edge of the plate partially blocking a leading one of said plurality of ports and positioned to direct flow through the leading port preferentially along the pressure side of the leading edge portion of the wall of the body tip pocket.

3. The blade of claim 2 wherein the plate leading edge is angled forwardly relative to a local mean of a section of the airfoil.

4. The blade of claim 2 wherein an area of said leading port blocked by the plate on a suction side of a mean line is 2–6 times an area of said leading port blocked by the plate on a pressure side of said mean line.

5. The blade of claim 2 wherein an area of said leading port blocked by the plate on a suction side of a mean line is 4–5 times an area of said leading port blocked by the plate on a pressure side of said mean line.

6. The blade of claim 1 wherein a length along a pressure side of a wall of the blade tip pocket ahead of the plate is 1.1–4.0 times a length along a suction side of a wall of the blade tip pocket ahead of the plate.

7. The blade of claim 1 wherein a length along a pressure side of a wall of the blade tip pocket ahead of the plate is 1.5–2.0 times a length along a suction side of a wall of the blade tip pocket ahead of the plate.

8. The blade of claim 1 further comprising: means for preferentially diverting flow from a trailing passageway of said internal cooling passageway network to the pressure side of the wall of the body tip pocket.

9. The blade of claim 1 wherein the wall has a pressure side trailing edge gap and the blade further comprises means for limiting stress concentration at the gap.

10. A blade comprising:

an airfoil body having:

an internal cooling passageway network; and having a body tip pocket in communication with the cooling passageway network via a plurality of ports; and at least one plate secured within the body tip pocket, subflush to the tip so as to leave a blade tip pocket adjacent the tip and at least partially blocking at least some of the plurality of ports and having means for preferentially diverting flow from a trailing-most passageway of said internal cooling passageway network to a pressure side of a wall of the body tip pocket relative to a suction side of the wall.

11. The blade of claim 10 wherein:

the means comprises a trailing portion of the plate partially blocking at least one of said plurality of ports and positioned to direct flow through said at least one port preferentially along the pressure side portion of the wall of the body tip pocket.

12. A blade comprising:

a platform; and an airfoil:

extending along a length from a root at the platform to a tip;

having leading and trailing edges separating pressure and suction sides;

having a cooling passageway network; and having a tip pocket in communication with the cooling passageway network, the tip pocket being bounded by a wall along at least portions of said pressure and suction sides, the wall having a gap at a trailing edge portion of a first of said pressure and suction sides, the gap being in communication with the tip pocket and having a depth and a length, the wall having a trailing end at the gap, wherein the wall has a radius of curvature at a leading inboard corner of the gap of between 0.100 inch and 0.300 inch.

13. The blade of claim 12 wherein the first side is the pressure side.

14. The blade of claim 12 wherein the airfoil comprises:

an airfoil body, unitarily formed with the platform; and at least one plate forming a bottom portion of the tip pocket, subflush to the tip, and welded to the airfoil body.

15. The blade of claim 14 wherein:

the plate has a leading edge angled forwardly relative to a local mean of a section of the airfoil.

16. A blade comprising:

a platform; and an airfoil:

extending along a length from a root at the platform to a tip;

having leading and trailing edges separating pressure and suction sides;

having a cooling passageway network; and having a tip pocket in communication with the cooling passageway network, the tip pocket being bounded by a wall along at least portions of said pressure and suction sides, the wall having a gap at a trailing edge portion of a first of said pressure and suction aides, the gap having a depth and a length, the wall having a trailing end at the gap, wherein the wall has a radius of curvature at a leading inboard corner of the gap of between 0.100 inch and 0.300 inch, wherein the airfoil comprises:

an airfoil body, unitarily formed with the platform; and at least one plate forming a bottom portion of the tip pocket, subflush to the tip, and welded to the airfoil body, the plate further having means for directing airflow preferentially along a pressure side of a leading edge portion of the wall of the body tip pocket relative to a suction side of the leading edge portion of the wall of the body tip pocket.

17. A blade comprising:

an airfoil body having:

an internal cooling passageway network; and having a body tip pocket in communication with the cooling passageway network via a plurality of ports; and at least one plate secured within the body tip pocket, subflush to the tip so as to leave a blade tip pocket adjacent the tip and at least partially blocking at least some of the plurality of ports and having means for preferentially diverting flow from a trailing passageway of said internal cooling passageway network to a pressure side of a wall of the body tip pocket relative to a suction aide of the wall, the plate further having means for directing airflow preferentially along a pressure side of a leading edge portion of the wall of the body tip pocket relative to a suction side of the leading edge portion of the wall of the body tip pocket.

18. The blade of claim 17 wherein:

the plate has a leading edge angled forwardly relative to a local mean of a section of the airfoil.

19. A blade comprising:

an airfoil body having:

an internal cooling passageway network; and having a body tip pocket in communication with the cooling passageway network via a plurality of ports; and at least one plate secured within the body tip pocket, subflush to the tip so as to leave a blade tip pocket adjacent the tip and at least partially blocking at least some of the plurality of ports and having means for preferentially diverting flow from a trailing passageway of said internal cooling passageway network to a pressure side of a wall of the body tip pocket relative to a suction side of the wall, the means comprising a trailing portion of the plate partially blocking at least one of said plurality of ports and positioned to direct flow through said at least one port preferentially along the pressure side portion of the wall of the body tip pocket, the plate trailing portion along a suction side protruding relative to a portion thereahead.

20. A blade comprising:

an airfoil body having:

an internal cooling passageway network; and having a body tip pocket in communication with the cooling passageway network via a plurality of ports; and at least one plate secured within the body tip pocket, subflush to the tip so as to leave a blade tip pocket adjacent the tip and at least partially blocking at least some of the plurality of ports and having means for preferentially diverting flow from a trailing passageway of said internal cooling passageway network to a pressure side of a wall of the body tip pocket relative to a suction side of the wall, the means comprising a trailing portion of the plate partially blocking at least one of said plurality of ports and positioned to direct flow through said at least one port preferentially along the pressure side portion of the wall of the body tip pocket, the plate trailing portion along a pressure side being recessed relative to a portion thereahead.

* * * * *

UNITED STATES PATENT AND TRADEMARK OFFICE

CERTIFICATE OF CORRECTION

PATENT NO. : 7,059,834 B2
APPLICATION NO. : 10/350635
DATED : June 13, 2006
INVENTOR(S) : Wieslaw A. Chlus et al.

It is certified that error appears in the above-identified patent and that said Letters Patent is hereby corrected as shown below:

In column 6, claim 16, line 39, “aides” should read --sides--.

In column 6, claim 17, line 67, “aide” should read --side--.

Signed and Sealed this

Tenth Day of April, 2007

JON W. DUDAS
*Director of the United States Patent and Trademark Office*